United States Patent [19]

Austin

[11] 4,191,289

[45] Mar. 4, 1980

[54] HOURGLASS CARTON

[75] Inventor: John J. Austin, Hinsdale, Ill.

[73] Assignee: Champion International Corporation, Stamford, Conn.

[21] Appl. No.: 256

[22] Filed: Jan. 2, 1979

[51] Int. Cl.[2] ..... B65D 5/42; B65D 75/00

[52] U.S. Cl. ..... 206/45.14; 206/45.31; 206/485; 206/590

[58] Field of Search ..... 206/45.14, 45.31, 45.34, 206/426, 485, 491, 590, 592; 229/8, 16 D, 22, 39 B

[56] References Cited

U.S. PATENT DOCUMENTS

| | | | |
|---|---|---|---|
| 2,515,026 | 7/1950 | Van Rosen | 206/45.14 |
| 2,955,706 | 10/1960 | Emrick | 206/45.14 |
| 3,206,013 | 9/1965 | Stone | 206/45.14 |
| 3,241,660 | 3/1966 | Cathcart, Jr. et al. | 206/45.14 |
| 3,311,282 | 3/1967 | Burgess | 206/45.31 X |
| 3,593,846 | 7/1971 | Dolas | 206/45.14 |
| 3,815,735 | 6/1974 | Cucuo | 206/485 |
| 3,887,067 | 6/1975 | Collura et al. | 206/45.14 |

FOREIGN PATENT DOCUMENTS

| | | | |
|---|---|---|---|
| 972329 | 8/1975 | Canada | 206/45.14 |
| 966033 | 8/1964 | United Kingdom | 229/8 |
| 1217067 | 12/1970 | United Kingdom | 206/45.31 |
| 1495268 | 12/1977 | United Kingdom | 206/45.14 |

*Primary Examiner*—Steven E. Lipman
*Attorney, Agent, or Firm*—Evelyn M. Sommer

[57] ABSTRACT

A self-standing display carton for containing and displaying an article has a generally hourglass configuration and comprises first and second spaced apart end walls and four upstanding sidewalls connecting the end walls. The sidewalls include a first pair of sidewalls, each having a generally U-shaped configuration including first and second end panels and an intermediate panel disposed between the end panels, the end panels inclining inwardly from their respective end wall to their respective intermediate panel. The intermediate panels of the first pair of sidewalls are in substantial abutting relationship and disposed generally perpendicular to the planes of the first and second end walls. Each of the first pair of sidewalls includes an aperture substantially conforming to the configuration of the article to be contained within the carton. The carton further includes a second pair of sidewalls each of which includes first and second spaced apart end portions and a central profile portion integral with and disposed between its respective end portions. Each of the end portions is generally triangular in configuration and disposed in mirror image relationship. Each profile portion has a length substantially equal to the width of the intermediate panels of the first pair of sidewalls and a width substantially equal to the sum of the thicknesses of the intermediate panels of the first pair of sidewalls. Thus, when the article is contained within the carton substantially the entire periphery of the article is visible.

5 Claims, 7 Drawing Figures

HOURGLASS CARTON

BACKGROUND OF THE INVENTION

The subject invention relates to paperboard cartons which are used for housing and displaying articles of manufacture such as bottles or tubes containing pharmaceuticals or cosmetics. An example of a known display carton is illustrated in the patent to Harry I. Roccaforte, U.S. Pat. No. 4,037,717, issued July 26, 1977, and entitled "DISPLAY CARTON," the assignee of said patent being the same as that of the present invention. As illustrated in said patent, known display cartons are generally box-like in construction, the article contained within the box being substantially fully enclosed therein except for an opening in the front panel through which the article may be viewed by a consumer. The box-like construction of the carton also permits the carton to be self-standing on a merchant's shelf. It has been found, however, that as the configuration of bottles and tubes containing pharmaceuticals and cosmetics become more fanciful, the manufacturers thereof desire that the display cartons housing the bottles and tubes provide maximum visibility thereof. It will be appreciated that maximum visibility of a distinctively configured article aids in consumer recognition of the products, and attendant therewith, promotes the sale of the products. While it is desired to have a display carton providing such maximum product visibility, it is also necessary that the carton provide ample space for advertising print, as well as means enabling the carton to be self-standing on a merchant's shelf. In addition, it is desired that such a display carton be simple in construction and able to be assembled and loaded with high speed automatic equipment.

Accordingly, it is an object of the subject invention to provide a self-standing display carton which is formed from a single blank of paperboard material, and which provides maximum visibility of the product to be contained therein, while also providing ample space for accommodating advertising print. It is another object of the subject invention to provide a display carton having the above recited characteristics which is simple in construction, and may be assembled and loaded with high speed automatic equipment.

SUMMARY OF THE INVENTION

In accordance with the above recited objectives, the subject display carton has a generally hourglass configuration in profile and comprises first and second, generally rectangular end walls, the end walls being spaced apart a distance substantially equal to the length of the article to be contained within the carton. Thus, the end walls are adapted to engage the ends of the article for inhibiting longitudinal movement thereof. Preferably, the end walls are substantially equal in length and width. The subject carton further includes four upstanding sidewalls which connect the end walls. More particularly, the carton includes a first pair of sidewalls which are generally U-shaped in configuration, each of the first pair of sidewalls including first and second end panels and an intermediate panel disposed between said end panels. Each of the first and second end panels extends from its respective first and second carton end walls and inclines inwardly to its respective intermediate panel, the intermediate panel of each of the first pair of sidewalls being disposed generally perpendicular to the planes of the first and second carton end walls.

Preferably, the intermediate panels of the first pair of sidewalls abut one another with one of said intermediate panels including a pair of hingedly connected lateral glue straps which overlap and are adhered to the other intermediate panel for maintaining said intermediate panels in abutting relationship. Each of the first pair of sidewalls also includes an aperture which substantially conforms to the configuration of the article to be contained therein, the width of each sidewall aperture being substantially the same as the width of the article to be contained within the carton so as to preclude lateral movement of the article. Preferably, the end panels and intermediate panel of each of the first pair of sidewalls are equal in length and width. In addition, it is preferable that the intermediate panels be disposed substantially midway the width of the carton end walls such that the carton stands erect in the fully assembled state.

The subject carton further comprises a second pair of sidewalls, each of the second pair of sidewalls including a pair of spaced apart end portions and a central profile portion which is integral with and disposed between said end portions. Each of the end portions of said second pair of sidewalls is generally triangular in configuration, preferably an isosceles triangle in configuration, the end portions being disposed in mirror image relationship, with the equal sides of each triangular end portion extending from its respective carton end wall to its respective profile portion. Each profile portion of the second pair of sidewalls has a length equal to the width of the intermediate panels of the first pair of sidewalls. In addition, each of said profile portions has a width substantially equal to the sum of the thicknesses of the intermediate panels of the first pair of sidewalls and the thickness of each glue strap which maintains said intermediate panels in abutting relationship.

As a result, when an article is housed in the subject carton, the article is visible to a consumer through each of the first pair of sidewalls, and in addition, the portion of the article adjacent the profile portions of the second pair of sidewalls is virtually fully visible such that substantially the entire periphery of the article is visible to the consumer. While the subject carton provides such high visibility, there is also ample space on said end walls, and sidewalls for accommodating advertising print. In addition, the end walls of the carton provide means whereby the carton is self-standing.

DETAILED DESCRIPTION OF THE PREFERRED EMBODIMENT

Figure 1:
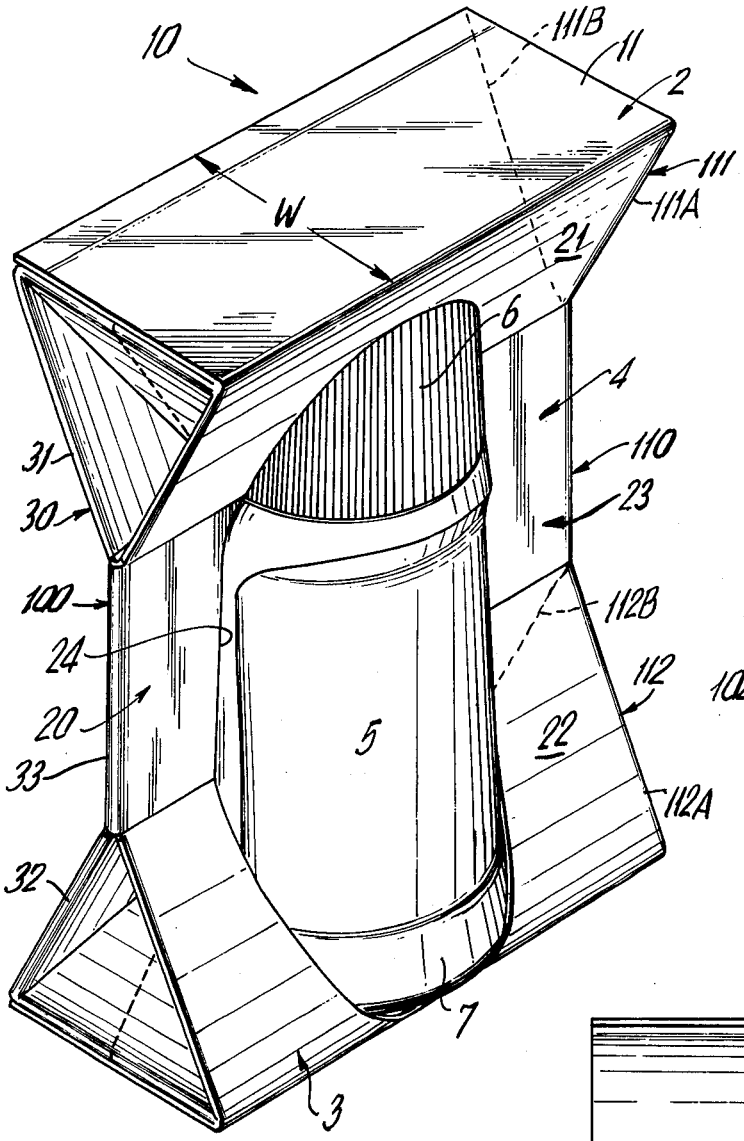
FIG. 1 is a perspective view of the display carton of the subject invention.
Figure 2:
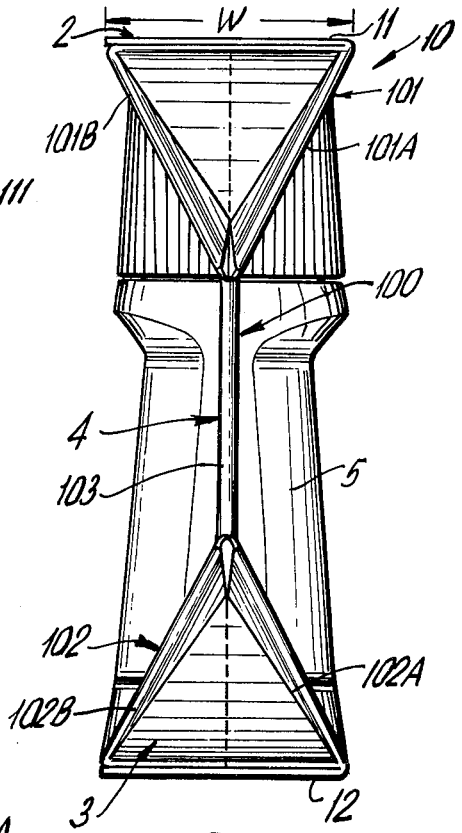
FIG. 2 is a first elevational view of the display carton of the subject invention.

Referring to FIGS. 1-2, the display carton of the subject invention is designated generally by reference numeral 10 and is shown housing a bottle 5 which may typically contain a cosmetic or pharmaceutical such as a roll-on deodorant. As illustrated in said figures, the subject display carton 10 is specifically configured so as to resemble an hourglass, the carton including substantially prismatic top and bottom portions 2 and 3, and a central generally planar intermediate portion 4 disposed between top and bottom portions 2 and 3. As illustrated in the figures, top and bottom portions 2 and 3 are generally triangular in cross-section having a maximum width W substantially equal to the depth of the bottle 5 contained therein. Top and bottom portions 2 and 3 taper in width as they approach intermediate portion 4, said intermediate portion having a width much less than the depth of the bottle 5 such that when the loaded carton 10 is viewed in profile, as shown in FIG. 2, substantially the entire periphery of the bottle 5 is exposed to view.

Figure 5:
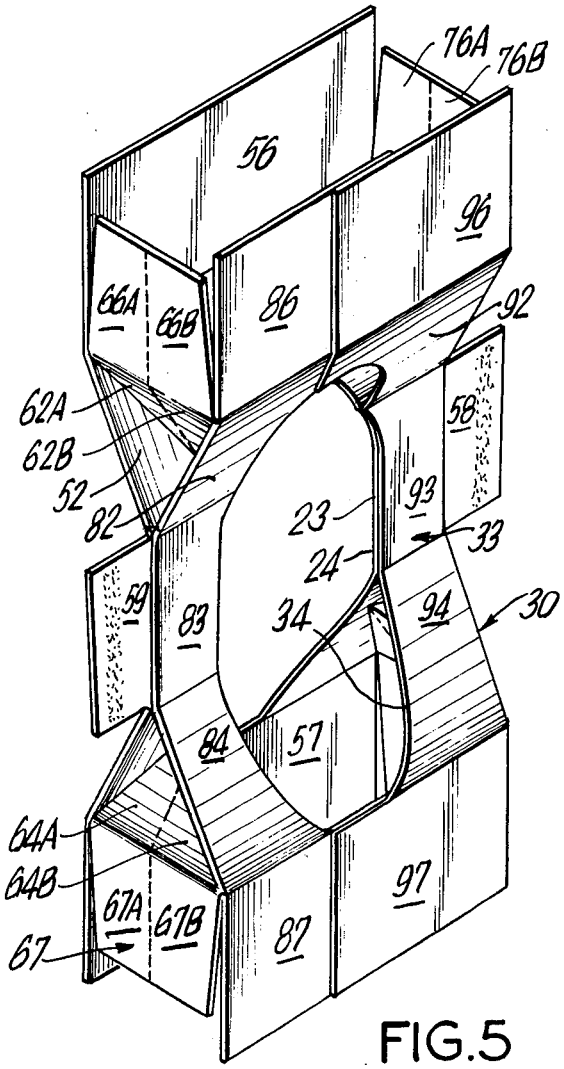
FIG. 5 is a perspective view of the display carton of the subject invention in a partially assembled state prior to the gluing of the profile maintaining glue straps.
Figure 6:
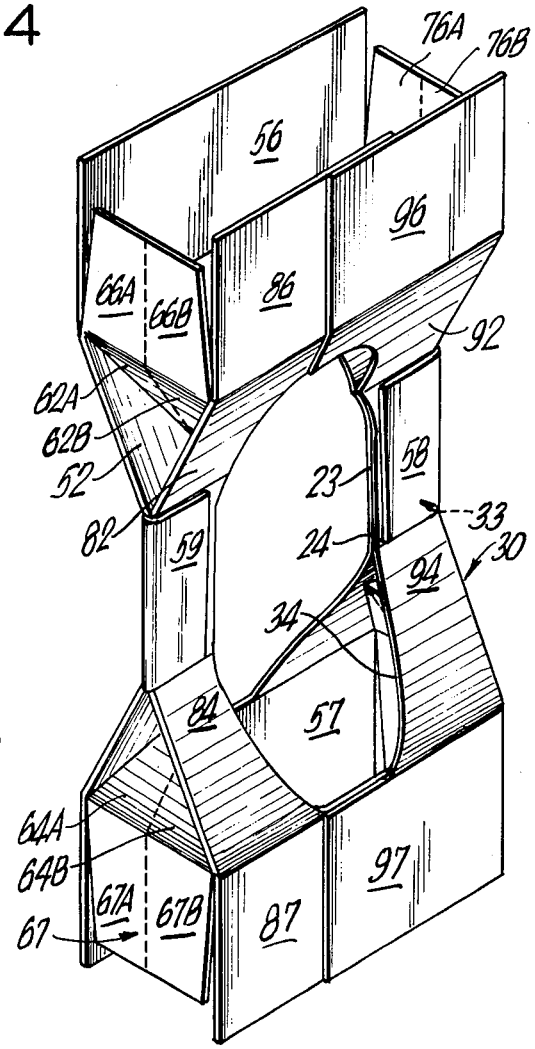
FIG. 6 is a perspective view of the display carton of the subject invention similar to that of FIG. 5 wherein the profile maintaining glue straps are adhered.

Turning now to a more detailed description of the present invention, the subject display carton 10 includes a top end wall 11 and a bottom end wall 12 which are substantially parallel to one another, said top and bottom walls preferably being generally rectangular in configuration and having substantially the same length and width. In addition, it is preferable that top and bottom walls 11 and 12 be spaced apart a distance substantially equal to the length of the bottle to be contained therein such that the inner surface of each top and bottom wall engages the cap 6 and base 7 of the bottle 5 so as to inhibit longitudinal movement of the bottle. The subject carton 10 further includes four upstanding sidewalls 20, 30, 100 and 110. More particularly, the subject carton 10 includes a first pair of opposed sidewalls 20 and 30 which are generally U-shaped in configuration. Thus, as illustrated in FIG. 1, sidewall 20 comprises first and second end panels 21 and 22 and an intermediate panel 23 disposed between end panels 21 and 22, end panel 21 extending from top wall 11 and inclining inwardly towards intermediate panel 23, and end panel 22 extending from bottom wall 12 and inclining inwardly towards intermediate panel 23. Similarly, sidewall 30 comprises first and second end panels 31 and 32 and an intermediate panel 33 disposed therebetween, first end panel 31 extending from top wall 11 and inclining inwardly towards intermediate panel 33, and second end panel 32 extending from bottom wall 12 and inclining inwardly towards intermediate panel 33. Preferably, intermediate panels 23 and 33 substantially abut one another such that said panels are disposed generally perpendicular to the planes of top and bottom walls 11 and 12, and preferably, in a plane substantially midway the widths of top and bottom walls 11 and 12. As illustrated in FIGS. 5 and 6, it is preferable that intermediate panel 23 include a pair of glue straps 58 and 59, each of which is hingedly connected to a lateral end of intermediate panel 23. Glue straps 58 and 59 overlap and are adhered to intermediate panel 33 so as to maintain intermediate panels 23 and 33 in abutting relationship.

Referring now to FIGS. 1 and 3, and 5-6, it will be noted that each of sidewalls 20 and 30 includes a central aperture 24 and 34, respectively, said apertures substantially conforming to the configuration of the article 5 to be contained within the carton. Preferably, the width of each aperture 24 and 34 is substantially the same as the width of bottle 5 so as to preclude lateral movement of the bottle in the carton. In addition, it is preferable that end panel 21 have substantially the same length and width as end panel 31, and that end panel 22 have substantially the same length and width as end panel 32.

Figure 3:
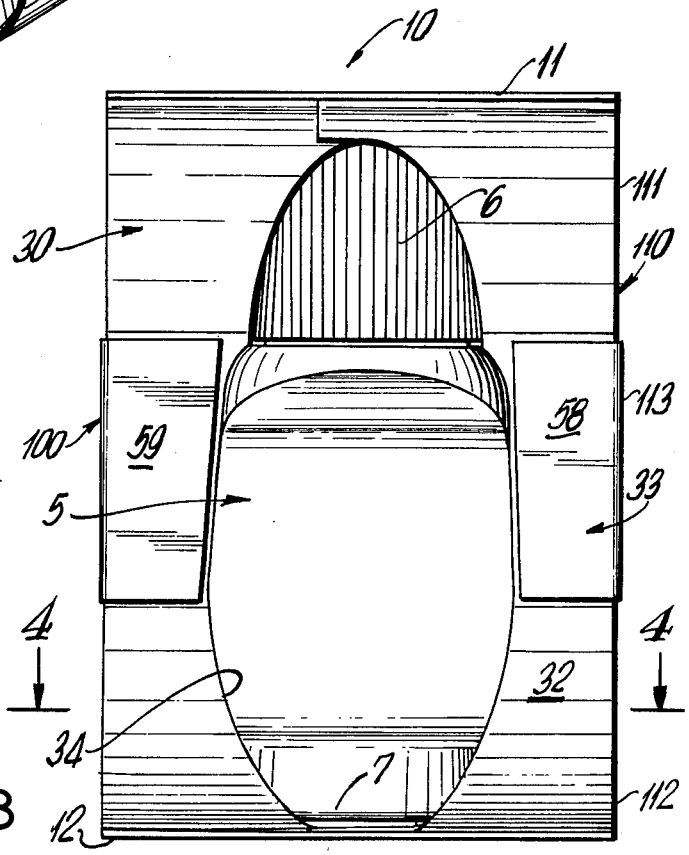
FIG. 3 is a second elevational view of the display carton of the subject invention.
Figure 4:
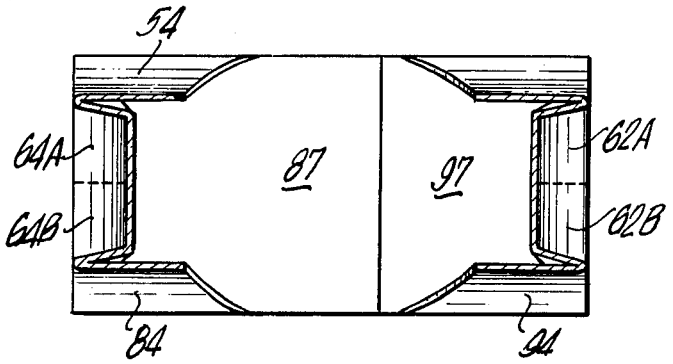
FIG. 4 is a cross sectional view of the display carton of the subject invention, taken along line 4—4 of FIG. 3.

Further referring to FIGS. 1-3, the subject carton 10 includes a second pair of sidewalls 100 and 110, respectively. As illustrated in the figures, sidewall 100 comprises a pair of spaced apart end portions 101 and 102, and a central profile portion 103 which is integral with and disposed between end portions 101 and 102. End portions 101 and 102 are each generally triangular in configuration and are disposed in mirror image relationship with one another. Preferably, each end portion 101 and 102 is an isosceles triangle in which equal side portions 101A and 101B, and 102A and 102B extend from their respective end walls 11 and 12 to profile portion 103. Similarly, sidewall 110 includes a pair of spaced apart end portions 111 and 112 and a profile portion 113 integral therewith and disposed therebetween. Preferably, end portions 111 and 112 are isosceles triangles disposed in mirror image relationship such that equal side portions 111A and 111B, and 112A and 112B extend from their respective top and bottom walls to profile portion 113. It will be noted that each profile portion 103 and 113 has a length substantially equal to the width of each intermediate panel 23 and 33 of sidewalls 20 and 30. In addition, each profile portion 103 and 113 has a width substantially equal to the sum of the thicknesses of intermediate panels 23 and 33 of sidewalls 20 and 30. When glue straps 58 and 59 are provided, the width of each profile portion 103 and 113 is further defined by the thickness of said glue straps. In any event, the width of profile portions 103 and 113 is much less than the depth of bottle 5. Thus, as is shown most clearly in FIGS. 1 and 2, when an article is housed within the subject carton, the article is visible to a consumer through each of sidewalls 20 and 30, and in addition, the portion of the article adjacent the profile portions 103 and 113 of sidewalls 100 and 110 is virtually fully visible such that substantially the entire periphery of the article is visible to the consumer.

Figure 7:
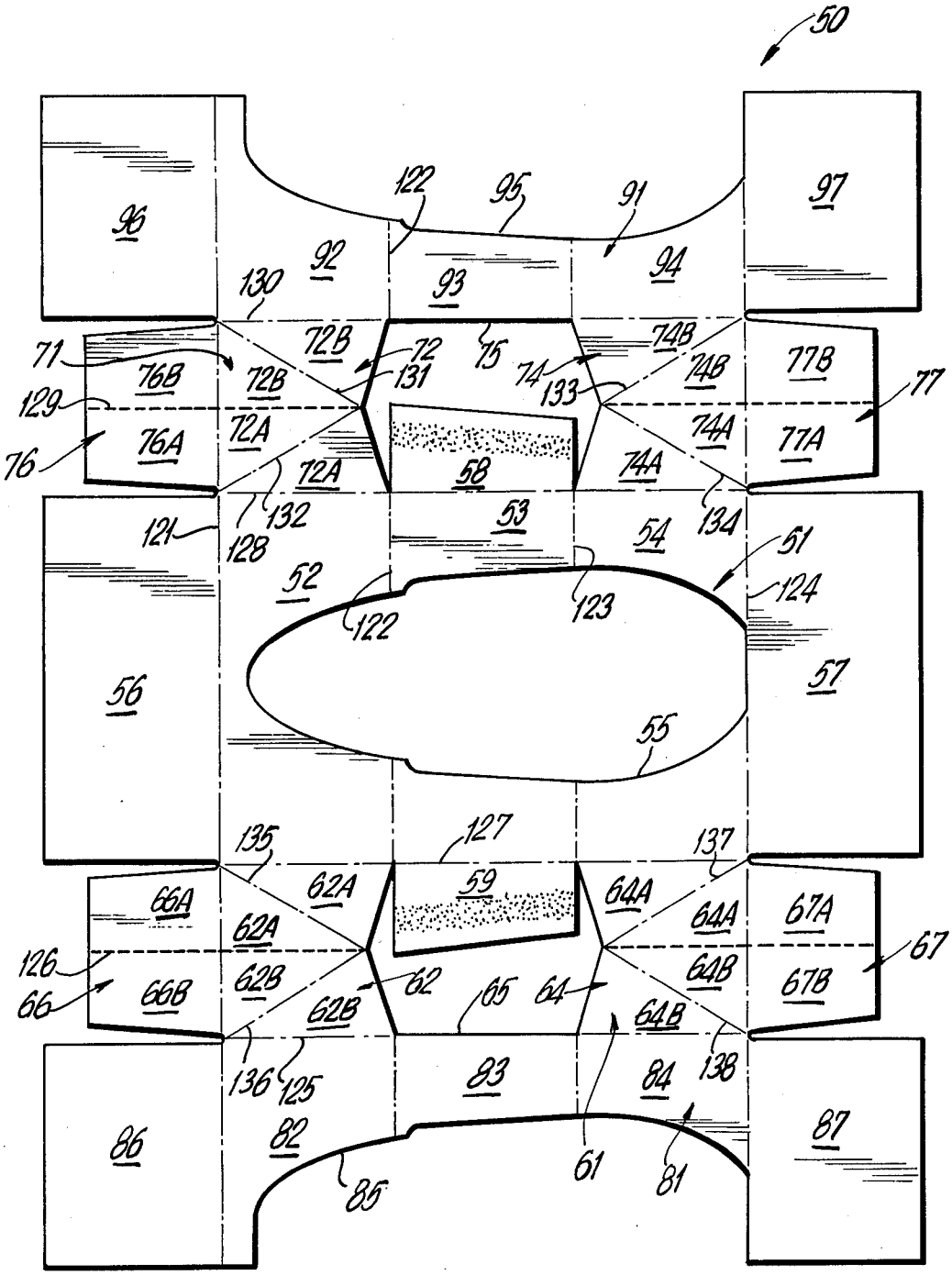
FIG. 7 is a plan view of the blank for forming the display carton of the subject invention.

Turning now to FIG. 7, the blank for forming the subject display carton is illustrated and designated generally by reference numeral 50. As illustrated in FIG. 7, the blank 50 includes a plurality of fold lines and cuts which enable the blank to be erected into the substantially hourglass configured display carton of the subject invention. More particularly, blank 50 includes a first side panel 51 which is generally rectangular in configuration and has a plurality of sections, typically three sections 52,53 and 54 which are hingedly connected to one another along the length of panel 51 along fold lines 122 and 123. First side panel 51 includes a central aperture 55 which conforms substantially to the configuration of the article to be housed within the erected carton. A pair of closure flaps 56 and 57 are hingedly connected to the ends of first side panel 51 along fold lines 121 and 124, respectively. First side panel 51 further includes a pair of glue straps 58 and 59, each of which being hingedly connected on the lateral sides of the panel along fold lines 128 and 127, respectively. The subject blank 50 further includes a first end panel 61 which is generally rectangular in configuration, and hingedly connected to first side panel 51 along fold line 127. First end panel 61 comprises a pair of spaced apart pleat sections 62 and 64, each pleat section comprising a plurality of hingedly connected triangular segments. As illustrated in FIG. 7, pleat section 62 comprises two pairs of triangular segments 62A and 62B, said pairs of segments being separated by perforated fold line 126. Segments 62A are hingedly connected to one another along diagonal fold line 135, and segments 62B are hingedly connected to one another along diagonal fold line 136. Similarly, pleat section 64 comprises two pairs of triangular segments 64A and 64B said pairs of segments being separated by perforated fold line 126. Segments 64A are hingedly connected to one another along diagonal fold line 137, and segments 64B are hingedly connected to one another along diagonal fold line 138. First end panel 61 further includes a central fold aperture 65 within which is disposed glue strap 59. A pair of closure flaps 66 and 67 is hingedly connected to the ends of first side panel 61 along fold lines 121 and 124, respectively. As illustrated in FIG. 7, closure flap 66 and 67 are each divided by perforated fold line 126 into sections 66A, 66B and 67A, 67B.

Further referring to FIG. 7, the subject blank 50 further includes a second end panel 71 which is hingedly connected to the other side of first side panel 51 along fold line 128. Second end panel 71 is generally rectangular in configuration and includes a pair of spaced apart pleat sections 72 and 74, each pleat section including a plurality of hingedly connected triangular segments. More particularly, pleat section 72 includes two pairs of triangular segments 72A and 72B which are separated by perforated fold line 129, segments 72A being hingedly connected to one another along diagonal fold 132, and segments 72B being hingedly connected to one another along diagonal fold line 131. Similarly, pleat section 74 includes two pairs of triangular segments 74A and 74B which are separated by perforated fold line 129, segments 74A being hingedly connected to one another along diagonal fold line 134, and segments 74B being hingedly connected to one another along diagonal fold line 133. A pair of closure flaps 76 and 77 is hingedly connected to second side panel 71 along fold lines 121 and 124, respectively, closure flaps 76 being divided into portions 76A and 76B by perforated fold line 129, and closure flap 77 being divided into portions 77A and 77B by perforated fold line 129.

The subject blank 50 further includes a first partial second side panel 81 which is hingedly connected to first end panel 61 along fold line 125. Panel 81 is divided into three sections, 82, 83 and 84 by fold lines 122 and 123, and includes a generally U-shaped cut 85 which corresponds substantially to one half the configuration of the article to be housed within the erected carton. A pair of closure flaps 86 and 87 is hingedly connected to first partial second side panel 81 along fold lines 121 and 124, respectively.

A second partial second side panel 91 is hingedly connected to second end panel 71 along fold line 130. Second partial second side panel 91 is divided into sections 92, 93, and 94 by fold lines 122 and 123, and includes a generally U-shaped cut 95 which substantially conforms to the configuration of one half the article to be housed within the erected carton. A pair of closure flaps 96 and 97 is hingedly connected to the ends of second partial second side panel 91 slong fold lines 121 and 124, respectively.

Referring now to FIGS. 4–7, the subject carton is erected by folding first and second partial side panels 81 and 91 along fold lines 125 and 130, respectively, and also folding first and second end panels 61 and 71 along fold lines 127 and 128, respectively. Thus, as shown in FIGS. 5 and 6, closure flaps 87, second partial side panel 81, and closure flap 86 overlap closure flap 97, partial side panel 91 and closure flap 96, respectively, overlapping partial side panels 81 and 91 combining to form carton sidewall 30. In addition, end panel pleat segments 62A, 62B, 64A, 64B, 72A, 72B, 74A and 74B are folded along their respective fold lines so as to form triangular sidewall end portions 101, 102, 111, and 112. Referring to FIGS. 7 and 5, it will be noted that glue straps 58 and 59 which are hingedly connected to the lateral portions of side panel intermediate section 53 includes an adhesive such that the straps may be folded over and adhered to partial side panel intermediate sections 93 and 83, respectively. Thus, as shown in FIG. 6, the intermediate portions of sidewalls 20 and 30 are maintained in abutting relationship.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A paperboard blank for forming a display carton of generally hourglass configuration, comprising: a first side panel generally rectangular in configuration said first side panel including a plurality of hingedly connected sections extending the length of said first side panel, said first side panel further including a central aperture, said central aperture conforming substantially to the configuration of the article to be contained within the carton; a pair of closure flaps each being hingedly connected to one end of said first side panel: a first end panel generally rectangular in configuration hingedly connected to one side of said first side panel, said first end panel having a pair of spaced apart pleat sections; a pair of closure flaps hingedly connected to each end of said first end panel; a second end panel hingedly connected to the other side of said first side panel, said second end panel having a pair of spaced apart pleat sections, there being a fold aperture disposed between said pleat sections; a pair of closure flaps, each of which being connected to an end of said second side panel; a pair of glue straps, each of which being hingedly connected to one side of said first side panel, each of said glue straps being disposed in one of the fold apertures of said first and second end panels; a first partial second side panel hingedly connected to said first end panel, said first partial second side panel including three hingedly connected sections extending along the length of said first partial second side panel, said first partial second side panel including a generally U-shaped cut which approximates one half of the configuration of the article to be contained in the carton; a pair of closure flaps each of which being hingedly connected to one end of said first partial second side panel; a second partial second side panel hingedly connected to said second end panel, said second partial second side panel including a plurality of panel sections hingedly connected along the length of said second partial second side panel, said second partial second side panel including a generally U-shaped aperture approximating one half the configuration of the article to be contained within the carton; and a pair of closure flaps, each of which are being hingedly connected to one end of second partial second side panel.

2. A paperboard blank as recited in claim 1 in which the aperture of said first side panel has a width substantially equal to the width of the article to be contained within the carton.

3. A paperboard blank as recited in claim 1 in which each of the pleat sections of said first and second end panels includes a plurality of hingedly connected triangular segments.

4. A paperboard blank as recited in claim 1 in which the lengths of said first side panel, said first and second end panels, and said first and second partial second side panels are substantially equal to the length of the article to be contained within the carton.

5. A paperboard blank for forming a display carton of generally hourglass configuration, comprising: a first side panel generally rectangular in configuration said first side panel including a plurality of hingedly connected sections extending the length of said first side panel, said first side panel further including a central aperture, said central aperture conforming substantially to the configuration of the article to be contained within the carton, and having a width substantially equal to the width of the article to be contained within the carton; a pair of closure flaps each being hingedly connected to one end of said first side panel: a first end panel generally rectangular in configuration hingedly connected to one side of said first side panel, said first end panel having a pair of spaced apart pleat sections having a fold aperture disposed between said pleat sections, each of said pleat sections including a plurality of hingedly connected triangular segments; a pair of closure flaps hingedly connected to each end of said first end panel; a second end panel hingedly connected to the other side of said first side panel, said second end panel having a pair of spaced apart pleat sections, there being a fold aperture disposed between said pleat sections, each of said pleat sections including a plurality of hingedly connected triangular segments; a pair of closure flaps, each of which being connected to an end of said second side panel; a pair of glue straps, each of which being hingedly connected to one side of said first side panel, each of said glue straps being disposed in one of the fold apertures of said first and second end panels; a first partial second side panel hingedly connected to said first end panel, said first partial second side panel including a plurality of hingedly connected sections extending along the length of said first partial second side panel, said first partial second side panel including a generally U-shaped cut which approximates one half of the configuration of the article to be contained in the carton; a pair of closure flaps each of which being hingedly connected to one end of said first partial second side panel; a second partial second side panel hingedly connected to said second end panel, said second partial second side panel including a plurality of panel sections hingedly connected along the length of said second partial second side panel, said second partial second side panel including a generally U-shaped aperture approximating one half the configuration of the article to be contained within the carton; and a pair of closure flaps, each of which are being hingedly connected to one end of second partial second side panel, the lengths of said first side panel, said first and second end panels, and said first and second partial second side panels being substantially equal to the length of the article to be contained within the carton.

* * * * *